United States Patent [19]

Todd

[11] Patent Number: 4,889,337

[45] Date of Patent: Dec. 26, 1989

[54] RACQUET SHOCK ABSORBING DEVICE

[75] Inventor: Barry A. H. Todd, Mosman, Australia

[73] Assignee: Fin Sports Limited, Aylesbury Bucks, England

[21] Appl. No.: 331,033

[22] Filed: Mar. 30, 1989

Related U.S. Application Data

[63] Continuation of Ser. No. 918,216, Oct. 14, 1986, abandoned.

[30] Foreign Application Priority Data

Jun. 3, 1988 [AU] Australia ..... PH2864

[51] Int. Cl.[4] ..... A63B 49/14

[52] U.S. Cl. ..... 273/73 D; 273/73 C

[58] Field of Search ..... 273/73 D, 73 R, 73 C, 273/73 E, 73 H

[56] References Cited

U.S. PATENT DOCUMENTS

| | | | |
|---|---|---|---|
| 3,642,283 | 2/1972 | Wilkens | 273/73 H |
| 4,697,811 | 10/1987 | Muroi | 273/73 C |

FOREIGN PATENT DOCUMENTS

| | | | |
|---|---|---|---|
| 553218 | 8/1986 | Australia . | |
| 0201953 | 11/1986 | European Pat. Off. | 273/73 C |
| 627240 | 8/1949 | United Kingdom | 273/73 D |
| 2014459 | 8/1979 | United Kingdom | 273/73 D |
| 1565485 | 4/1980 | United Kingdom | 273/73 D |

*Primary Examiner*—Edward M. Coven
*Assistant Examiner*—William E. Stoll
*Attorney, Agent, or Firm*—Sixbey, Friedman, Leedom & Ferguson

[57] ABSTRACT

A shock absorbing device for a racquet comprising a strip of resilient material, a central spine on the strip for location within a grommet recess in the racquet head, a plurality of apertures through the spin in alignment with string holes in the racquet head, longitudinally extending integral beading on either side of the spine for at least partial covering of the outer edges of the racquet head adjacent the grommet recess, and one or more protuberances formed along the inner surface of the beading for engagement with the racquet head. The protuberances increase the ability of the resilient strip to absorb shock which otherwise would be transmitted to the racquet frame and arm of the user.

3 Claims, 1 Drawing Sheet

RACQUET SHOCK ABSORBING DEVICE

This application is a continuation of application Ser. No. 918,216, filed Oct. 14, 1986, now abandoned.

This invention relates to strung racquets, and more especially to shock absorbing means utilized in such racquets.

Racquets strung with gut, or other filamentary material, have been used in the playing of many sports and are subjected to high impact forces both in normal usage and quite unintentionally in striking hard surfaces. The frame construction was formerly of laminated wood with a degree of resilience which provided protection against these forces. There has been a growing trend for racquet frames to be constructed of metal, fibre-glass and graphite. However, although having good strength and light-weight properties some of these materials have been found too brittle to withstand the impacting forces. Furthermore, vibration can be transmitted from the frame to the arm of the user and contribute to injury.

SUMMARY OF THE INVENTION

It is an object of the invention to provide means for absorbing shock imparted to a racquet and which does not substantially affect the racquet balance.

Accordingly, this invention consists in a shock absorbing device for a racquet, comprising a strip of resilient material, a central spine on the strip for location within a grommet recess in the racquet head, a plurality of apertures through the spine for alignment with string holes in the racquet head, longitudinally extending integral beading to either side of the spine for at least partial covering of the outer edges of the racquet head adjacent the grommet recess, and one or more protuberances formed along the inner surface of the beading for engagement with the racquet head to cushion impact forces delivered thereto.

For preference, a plurality of integrally formed grommets extend from said spine for insertion within string holes of the racquet, the bore of each grommet respectively coinciding with one of the apertures.

Also for preference, the spine has one or more interruptions in the inner racquet engaging face thereof, said interruptions being formed between the apertures and including a plurality of protuberances formed therein to engage the bottom of the grommet recess. This arrangement provides for additional absorption of impact forces delivered to the device.

To provide for tying-off of strings one or more recesses are preferably formed in the outer racquet remote face of the spine, the recesses extending between two or more of the apertures and being longitudinally spaced from the interruptions in the inner face of the spine. This spacing prevents weakening of the spine as would occur if the recesses and interruptions coincided.

BRIEF DESCRIPTION OF THE SEVERAL FIGURES

The invention will be described, by way of example only, with reference to the accompanying drawings, in which.

DETAILED DESCRIPTION OF THE PREFERRED EMBODIMENT

Figures 1, 2:
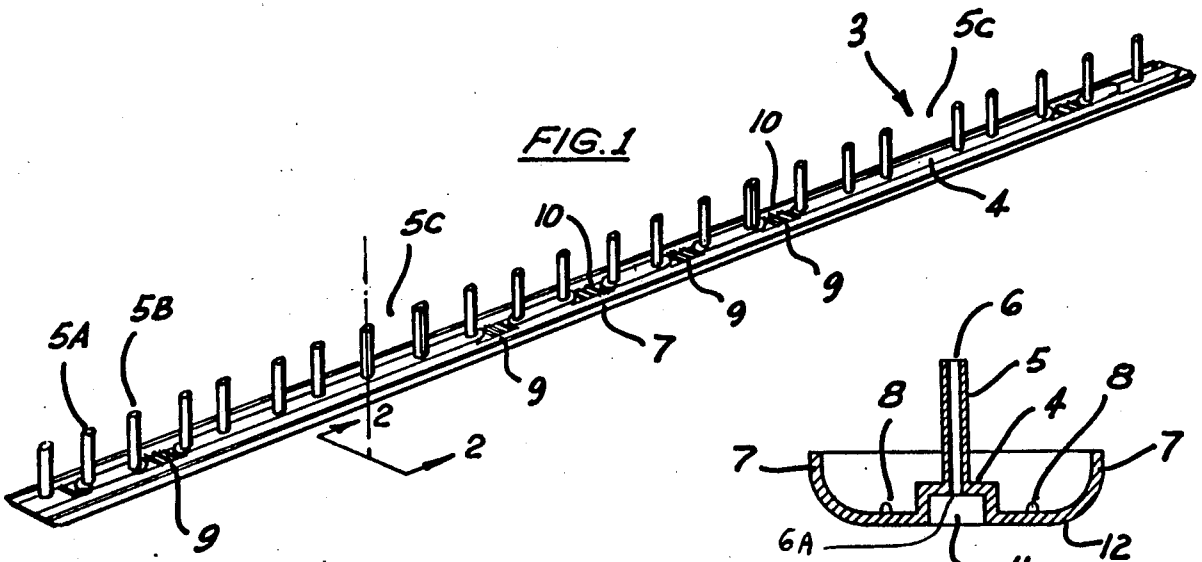
FIG. 1 shows in perspective a device according to this invention.
FIG. 2 is a sectional view on the line 2—2 of FIG. 1.

The shock absorbing device 3 shown in the drawings consists of a moulded strip of thermoplastic material, provided with a degree of resiliency, which is intended for insertion within the grommet recess provided in the outer periphery of a racquet head (not shown). The device 3 consists of a central longitudinally extending spine 4 supporting integral upstanding grommets 5 each provided with an axial bore 6. Apertures **6*a* are formed through the spine 4 and are spaced for alignment with the string holes in the racquet. The bore 6 of each grommet 5 coincides with one of the apertures 6*a*. The spacing of the grommets 5 thus corresponds in position with the string holes in the racquet head so that each grommet 5 extends through a respective string hole when the device 3 is applied to the grommet recess of the racquet head. Stringing for the racquet will therefore be passed through a grommet 5*a* and back through the grommet 5*b* to secure the device 3 in position upon the racquet. It will be noted from FIG. 1 that some grommets 5 are arranged in larger groups than others, such as grouping 5*c*** and this is for the purpose of tying-off of strings in a manner which will be made clear hereafter.

The device 3 is provided with lateral beadings 7 extending longitudinally of the device and to either side of the spine 4. The beadings 7 are arcuate in transverse cross section so that when the device is positioned upon the racquet head the beading 7 will extend from the grommet recess to, or enclose the outer edges of the racquet head. This provision will safeguard against abrasion to the racquet frame, but by this invention a row of protuberances 8 are integrally formed on the inner surface of each beading 7. They will function to absorb impact shocks delivered to the side of the racquet head. The protuberances 8 may be of many forms such as a continuous, or discontinuous rib, (not shown), prongs or spikes (not shown) or a series of raised dots as shown. It will be apparent that the beadings can be any suitable transverse cross-sectional shape and need only partly cover the outer edge of the racquet head.

For additional absorption of such forces further protuberances 9 are formed at interruptions 10 in the inner racquet engaging face of the spine 4 at spaced intervals therealong. When the device 3 is in position upon a racquet the protuberances 9 will engage with the bottom of the grommet recess therein. Thus the spine 4 does not possess a uniform thickness of material throughout its length. In a grouping of grommets 5 such as group **5*c* a recess 11 is provided in the outer racquet remote face 12 of the device 3 which, as shown in FIG. 1, communicates with a group of four grommets 5. Thus, tying-off of strings may be effected between these four grommets 5 without exposure beyond the surface 12. However, wherever an interruption 10 is provided on the inner face of the device 3 no recess 11 is provided thereunder. Therefore, the spine 4 is thickened immediately beneath any interruption 10 to improve the shock absorbing quality of the device 3**.

It should be understood that the foregoing described embodiment has been provided merely as an exemplary illustration of the principles of the invention.

I claim:

1. A shock absorbing device for a racquet formed in part by a head having an outer edge that includes string holes, comprising a strip of resilient material that includes a central longitudinally extending spine having a racquet engaging face, and an outer face, a plurality of apertures through the spine alignable with the string holes in a racquet head, longitudinally extending integral beading located along either side of the spine for at least partial covering of the outer edges of the racquet head, and one or more resilient protuberances formed along the beading for cushioning impact forces directed onto the racquet head by creating a shock absorbing gap between said strip and a racquet head, wherein one or more recesses are formed in the outer face of said spine, the recesses extending between two or more of said apertures and being longitudinally spaced from said interruptions in the racquet engaging face of the spine in order to avoid the weakening of the spine which would otherwise occur if the recesses and interruptions coincided.

2. A shock absorbing device for a racquet formed in part by a head having an outer edge that includes string holes, comprising a strip of resilient material that includes a central longitudinally extending spine having a racquet engaging face, and an outer face, a plurality of apertures through the spine alignable with the string holes in a racquet head, longitudinally extending integral beading located along either side of the spine for at least partial covering of the outer edges of the racquet head, and one or more resilient protuberances including a series of raised dots formed along the beading for cushioning impact forces directed onto the racquet head by creating a shock absorbing gap between said strip and a racquet head.

3. A shock absorbing device for a racquet formed in part by a head having an outer edge that includes string holes, comprising a strip of resilient material, that includes a central longitudinally extending spine having a racquet engaging face, and an outer face, a plurality of apertures through the spine adapted to be aligned with the string holes in a racquet head, longitudinally extending integral beading located along either side of the spine for at least partial covering of the outer edges of the racquet head, and one or more resilient protuberances formed along the beading for cushioning impact forces directed onto the racquet head by creating a shock absorbing gap between said strip and a racquet head, wherein said strip further includes a plurality of integrally formed grommets extending from said spine for insertion within the string holes of the racquet, the bore of each grommet respectively coinciding with one of said apertures.

* * * * *